United States Patent [19]

Brittingham

[11] 3,954,269

[45] May 4, 1976

[54] INDICIAED BALL HAVING LOOSE INTERIOR WEIGHT

[76] Inventor: Vertner David Brittingham, c/o W. C. Brittingham, 1722 Beacon Hill Road, Lexington, Ky. 40504

[22] Filed: Apr. 28, 1975

[21] Appl. No.: 572,285

[52] U.S. Cl. ..... 273/138 R; 273/58 F

[51] Int. Cl.[2] ..... A63B 71/06; A63F 9/04

[58] Field of Search ..... 273/138 R, 146, 143 A, 273/143 E, 143 R, 58 F, 58 K, 134 D, 135 AA, 128 R, 128 A, 95 R; 46/174, 175 R

[56] References Cited

UNITED STATES PATENTS

| | | | |
|---|---|---|---|
| 973,595 | 10/1910 | Wahlin | 273/146 |
| 1,857,902 | 5/1932 | Weber | 273/143 E |
| 2,219,154 | 10/1940 | Wahlberg | 273/138 R |
| 2,524,546 | 10/1950 | Sinclaire | 273/128 A |
| 2,859,968 | 11/1958 | Modica, Jr. | 273/58 F |
| 3,400,932 | 9/1968 | Conrad | 273/146 |
| D142,576 | 10/1945 | Morris | 273/146 UX |

FOREIGN PATENTS OR APPLICATIONS

| | | | |
|---|---|---|---|
| 870,967 | 7/1949 | Germany | 273/146 |
| 252,120 | 10/1912 | Germany | 273/58 F |
| 505,435 | 12/1954 | Italy | 273/58 F |
| 488,334 | 12/1929 | Germany | 273/143 R |
| 914,353 | 7/1954 | Germany | 273/58 F |
| 160,249 | 3/1921 | United Kingdom | 273/146 |

*Primary Examiner*—Richard C. Pinkham
*Assistant Examiner*—Arnold W. Kramer

[57] ABSTRACT

This invention pertains to a generally ball shaped device having a hollow interior chamber with a relatively small weight such as a steel ball bearing in said chamber; the exterior surface of the device is provided with a plurality of numbers or other symbols spaced thereabout, preferably in a symmetrical relationship. The interior chamber provides a pocket diametrically opposite to each symbol whereby the ball shaped object, when thrown along any flat surface or into water, will always come to rest with one symbol positioned on the top thereof diametrically opposite to the pocket in which the interior weight settles due to gravity forces.

1 Claim, 4 Drawing Figures

INDICIAED BALL HAVING LOOSE INTERIOR WEIGHT

OBJECTS AND ADVANTAGES OF THE PRESENT INVENTION

One of the principal objects of the present invention is to provide a generally ball shaped device with a hollow interior chamber which may be used in connection with a wide variety of games of chance wherein the appearance of a certain number or other symbol on the top of the device will determine the outcome of the game.

Another principal object of this invention is to provide a weighted object freely contained in said interior chamber which will settle in any one of a plurality of interior pockets each one of which is diametrically opposite one of the exterior numbers or other symbols.

A further object of the invention is to provide inwardlyextending surfaces between all of said interior pockets to insure the direction of the weighted object into one of the pockets when the ball comes to rest after being thrown.

Yet another object of the present invention is to provide a generally ball shaped device which may be provided with flat exterior areas about each number or other symbol.

A still further object of this invention is to provide such a generally ball shaped device which may be thrown in pairs and includes six dotted symbols symmetrically spaced about its outer surface in the same manner as dice and always presents one of said symbols on the top of each ball when it comes to rest after being thrown.

DETAILED DESCRIPTION OF THE DRAWINGS

Figure 1:
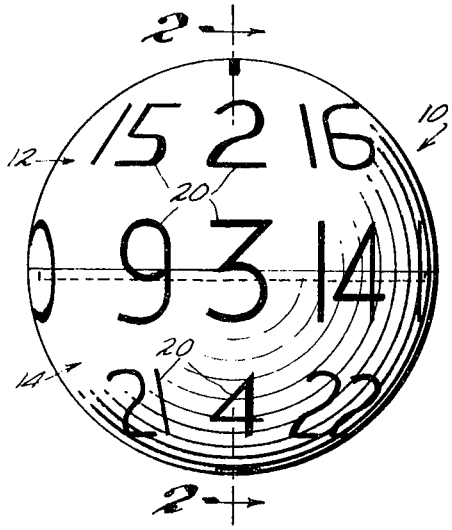
FIG. 1 is an elevational view of the freely interiorly weighted ball of the present invention.
Figure 2:
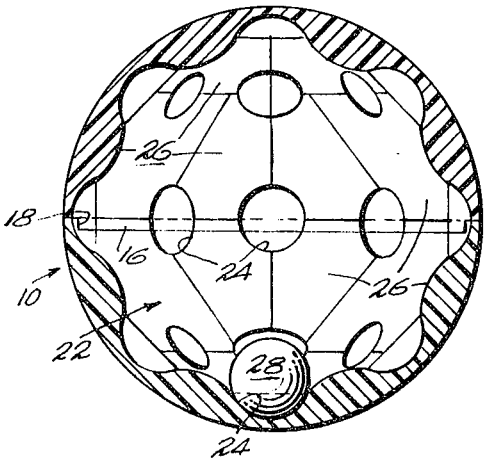
FIG. 2 is a cross-sectional view taken along the line 2—2 of FIG. 1.

With reference to the drawing in which like reference characters designate like or corresponding parts throughout the various views and with particular reference to FIGS. 1 and 2, the interiorly weighted ball of the present invention is designated generally at 10. The ball is fabricated of two halves 12 and 14. One half such as 12 preferably provides an inner annular flange 16 which seats against an annular shoulder 18 in the second half 14 to accurately position the two halves relative to each other.

The exterior surface of the ball includes a plurality of numbers or other symbols 20 either molded therein or applied thereto, which are preferably symmetrically spaced thereabout. As illustrated, the interior of the ball 10 is hollow as at 22 and provides a pocket 24 diametrically opposite each exterior number or other symbol 20. The interior wall areas between the respective pockets 24 slope inwardly from the pockets 24 as indicated at 26 by the interconnecting convex inner surface segments. A relatively small weight, such as a steel ball bearing 28 is placed in the interior chamber prior to sealing the two halves 12 and 14 together. The pockets 24 are sized to receive the weight 28.

In use, the ball may be rolled along any relatively level surface or thrown into water, and the weight 28 by gravity forces will settle into one of the pockets 24 and move to the lowest possible level presenting a symbol 20 in a diametrically opposite position which will be at the top of the ball.

Various modifications may be provided, for example, the number of symbols 20 on the exterior wall may be widely varied. The symbols 20 may be six in number and be in the form of dots as on dice and function in the same manner as dice if a pair of balls of the present invention are thrown at the same time. If desired, instead of being a perfect sphere, the ball may be provided with flat areas corresponding with each symbol to provide a more irregular movement thereof when rolled along any relatively hard surface. Its function if through into water would be relatively unchanged.

Figure 3:
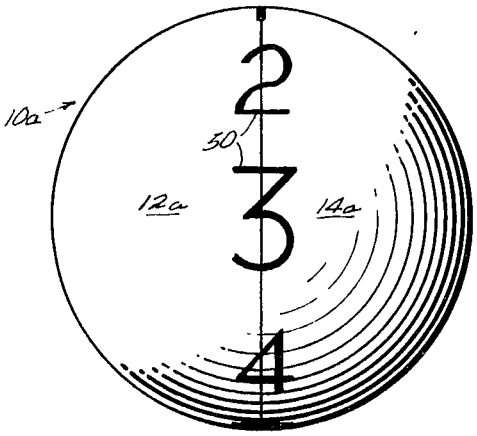
FIG. 3 is an elevational view similar to FIG. 1 illustrating a modified form of the invention.
Figure 4:
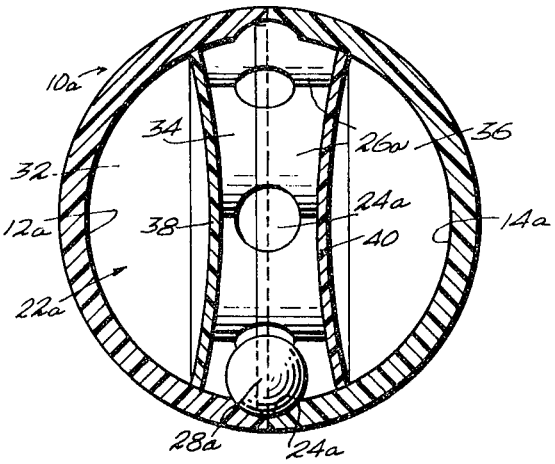
FIG. 4 is a vertical cross-sectional view of FIG. 3.

FIGS. 3 and 4 illustrate a modified form of the invention in which a single row of symbols such as numbers 30 extend circumferentially around the ball 10*a*. In this instance, the interior chamber 22*a* is separated into three portions 32, 34 and 36 by means of a pair of opposed, inwardly projecting convex discs 38 and 40 fixed as by adhesive means in the respective ball halves 12*a* and 14*a*. In this manner the weight 28 is confined to circular movement about the central chamber portion 34 and because of the interconnected convex inner wall surfaces 26*a* between pockets 24*a*, it will settle in one of said pockets 24*a*, position it at the bottom and present a diametrically opposite top symbol or number 30.

It will be obvious to anyone skilled in the art that numbers or any of a wide variety of other symbols may be molded into or applied to the exterior surface of the device in virtually any arrangement. As long as a pocket is provided, interiorly of the ball, diametrically opposite each of the numbers or symbols, gravity forces will cause one of the numbers or symbols to be presented atop the device when it comes to rest after being thrown along any relatively flat surface or into water. The device may be constructed within a wide range of sizes, for example, to simulate dice as aforementioned, or in the general form of a large ball for use in a swimming pool. In all cases, the size of the interior weight, such as ball 28, is in proportion to the overall size of the device to provide a perpendicular relationship between the weight at the bottom of the device and a symbol thereatop.

What is claimed is:

1. A symbol indicating device comprising a generally ball shaped object formed of two halves fixed together by a suitable adhesive means and providing a plurality of symbols disposed about the exterior surface thereof, a hollow, chamber defining interior and a pocket in said interior chamber diametrically opposite each of said symbols, and weight means freely disposed in said interior chamber to settle in any one of said pockets, when said ball shaped object comes to rest after movement thereof, to move said one pocket to the bottom of said chamber by gravity forces, thereby positioning the diametrically opposite symbol atop said exterior surface, said plurality of symbols being disposed in a single circumferential line about said exterior suface, said hollow, interior chamber being provided with a pair of spaced apart, opposed, inwardly convex discs, each fixed by a suitable adhesive to said interior to define a circumferential chamber therebetween corresponding to said single circumferential line, said weight means being freely disposed in said circumferential chamber.

* * * * *